United States Patent [19]

Baugh

[11] Patent Number: 4,629,003

[45] Date of Patent: Dec. 16, 1986

[54] GUILELINELESS SUBSEA COMPLETION SYSTEM WITH HORIZONTAL FLOWLINE CONNECTION

[76] Inventor: Benton F. Baugh, 14626 Oak Bend, Houston, Tex. 77079

[21] Appl. No.: 761,514

[22] Filed: Aug. 1, 1985

[51] Int. Cl.[4] ..... E21B 43/013

[52] U.S. Cl. ..... 166/341; 166/347

[58] Field of Search ..... 166/336, 343, 347, 349; 285/18, 29, 421

[56] References Cited

U.S. PATENT DOCUMENTS

| | | | |
|---|---|---|---|
| Re. 27,340 | 4/1972 | Williams et al. | 166/347 |
| 3,419,071 | 12/1968 | Williams, Jr. et al. | 166/347 |
| 3,503,442 | 3/1970 | Dodd et al. | 166/349 |
| 3,710,859 | 1/1973 | Hanes et al. | 166/347 |
| 3,716,100 | 2/1973 | Nelson | 166/347 |
| 3,722,585 | 3/1973 | Nelson et al. | 166/347 |
| 3,866,677 | 2/1975 | Baugh | 166/336 |
| 3,924,446 | 12/1975 | Baugh | 73/37 |
| 3,968,838 | 7/1976 | Baugh | 166/347 |
| 3,973,625 | 8/1976 | Baugh | 166/347 |

*Primary Examiner*—Stephen J. Novosad
*Assistant Examiner*—Terry Lee Melius

[57] ABSTRACT

An oil and gas completion system for landing and placement on an oceam floor without wire rope guidelines and in a nonoriented fashion including the end of a flowline laid along the ocean floor which is terminated substantially horizontally in a flowline receiving structure on the periphery of the completion system outside and below a specified circular boundary and a Christmas Tree having a mating end of a second flowline section inside the specified circular boundary and the extension of the second flowline section extending from the back of the second flowline section across to the other side of the tree being above said circular boundary such that the Christmas Tree is free to be rotated to an oriented position and one of the two flowline sections can then be moved substantially horizontally thru the boundary area for connection with the other section.

8 Claims, 6 Drawing Figures

GUILELINELESS SUBSEA COMPLETION SYSTEM WITH HORIZONTAL FLOWLINE CONNECTION

Oil and gas wells typically comprise downhole concentric pipes called casings and tubings, an arrangement of valves and fittings at the surface called a Christmas Tree, and flowlines which take the production away from the well or in some cases carries injection fluids or gases to the well. This basic arrangement is typical for wells on dry land or platforms, subsea wells which are landed with the guidance of wire rope guidelines from the surface, and guidelineless subsea wells which are landed with the assistance of television and/or sonar.

Characteristically, the flow will exit up thru the assembly of valves and make bends as required to pass down to and thru typically horizontal flowlines. In subsea applications the flowlines can be from a few hundred feet to several miles long. A requirement added to subsea flowlines which is not required on the surface flowlines is that the connection between the Christmas Tree and the flowlines needs to be made remotely.

The flowlines themselves are typically immobile because of settling into the mud on the ocean floor. This means that the half of the flowline connection on the Christmas Tree must be flexed away from the half of the flowline connection with the flowlines to allow vertical retrieval of the Christmas Tree.

Additionally, when the guidelineless Christmas Trees are landed, they must be oriented to a proper rotational position without the Christmas Tree half of the flowline connection striking the flowline half of the flowline connection. In addition to the problem of the interference between the two halves of the connection during the landing and orientation process, the flowline portion on the Christmas Tree usually called a flex loop and herein called a tree flowline loop portion will typically extend back away from the the back side of the flowline connection across the Christmas Tree and into an area that will interfere with the flowline receiving structure if the tree is approximately 180 degrees out of rotation. These problems do not exist on more conventional guideline guided Christmas Trees as the positive orientation provided by the guidelines prevents the interference between the parts on landing.

Page 1322 of the 1984–1985 Composite Catalog of Oilfield Equipment and Services Volume 1 shows a manner in which the interference of the flowline connector halves is handled in a deepwater guidelineless production system by one of the major manufacturers, Vetco, a subsidiary of Combustion Engineering. In this case a Christmas Tree is landed immediately above a wellhead system and the production is taken out of the assembly of valves thru curved pipes over to the right side of the tree and down to a hydraulic connector above the area titled Flowline Termination. This Flowline Termination is actually 90 degree bends of pipe which are the starting of the seabed flowlines. When the Christmas Tree is landed, the connector at the bottom of the tree locks onto the wellhead system and the connector on the flowlines locks onto the mandrel on the flowline termination. For this landing, the tree must be closely oriented, even in a guidelineless system. This type of system has inherent disadvantages including: 1. The flowlines must be landed with the bent pipes at the end of the flowlines, 2. the flowlines must be landed before the Christmas Tree, 3. the Christmas Tree must be retrieved before the flowlines can be replaced, and 4. the height and expense of the tree is increased to accommodate the vertical flowline connection.

Page 1662 of the same book shows a second design of a guidelineless Christmas Tree by a second manufacturer, Cameron Iron Works, Inc., which again uses a vertical connection as the means to resolve the problems associated with the guidelineless Christmas Tree flowline connections. In this case a Flowline Guide Funnel including a Hydraulic Tree Connector and two 90 degree bends of pipe indicated by the label "Flowline Position Latch" are used to land and align the flowlines before the Christmas Tree can be landed. The two 90 degree bends of pipe are latched into the vertical position by the Flowline Position Latches after the assembly is landed and the flowlines are laid down on the ocean floor. When the tree is landed, a second Hydraulic Tree Connector within the Tree Guide Funnel lands on top of the Flowline Guide Funnel and Hydraulic Flowline Connectors lock onto profiles on the upper end of the 90 degree bends of flowline. More detail on this system is available in the 1978 Offshore Technology Conference Paper no. 4251 titled "A Guidelineless Tree and a Flowline Connection for Deepwater Production" by H. O. Henderson. This system contains similar disadvantages to the previously mentioned system and additionally requires a second large wellhead connector.

SUMMARY OF THE INVENTION

The object of the present invention is to provide a means for a substantially horizontal flowline connection on a guidelineless Christmas Tree which will allow landing the tree in a non-oriented position and then rotating the tree to an oriented position for the connection of the flowlines.

A relationship is established between the half of the flowline connection associated with the sea floor flowlines (seafloor flowline end connection) and the half of the flowline connection associated with the Christmas Tree (tree flowline end connection) and the tree flowline loop portion between the tree flowline end connection and the Christmas Tree master valves such that the sea floor flowline end connection is outside and below a defined circular boundary, the tree flowline end connection is inside of the circular boundary in the running and landing position, and the tree flowline loop portion is above the circular boundary on the opposite side of the tree. After proper orientation of the Christmas Tree to the sea floor flowline end connection, the tree flowline end connection will move substantially horizontally and penetrate the circular boundary to lock onto and seal the sea floor flowline end connection.

BRIEF DESCRIPTION OF THE DRAWINGS

FIG. no. 1 is an overview of the application of this invention showing a Christmas Tree landed on the ocean floor below a floating drill ship at the surface of the ocean, FIG. No. 2 shows the Christmas Tree of FIG. No. 1 about to land on the wellhead system on the ocean floor, FIG. No. 3 shows the Christmas Tree landed on the wellhead system with the tree flowline end connection in a retracted position and having been rotationally aligned with the sea floor flowline end connection, FIG. No. 4 shows a top view of FIG. No. 3 taken along section lines "4—4" of FIG. No. 3, FIG. No. 5 shows the Christmas Tree with the tree flowline end connection moved forward and connected to the subsea flowline end connection, and FIG. No. 6 shows a top view of the Christmas Tree shown in FIG. No. 5 as taken along section lines "6—6" of section 5.

DESCRIPTION OF THE PREFERRED EMBODIMENT

Figure 1:
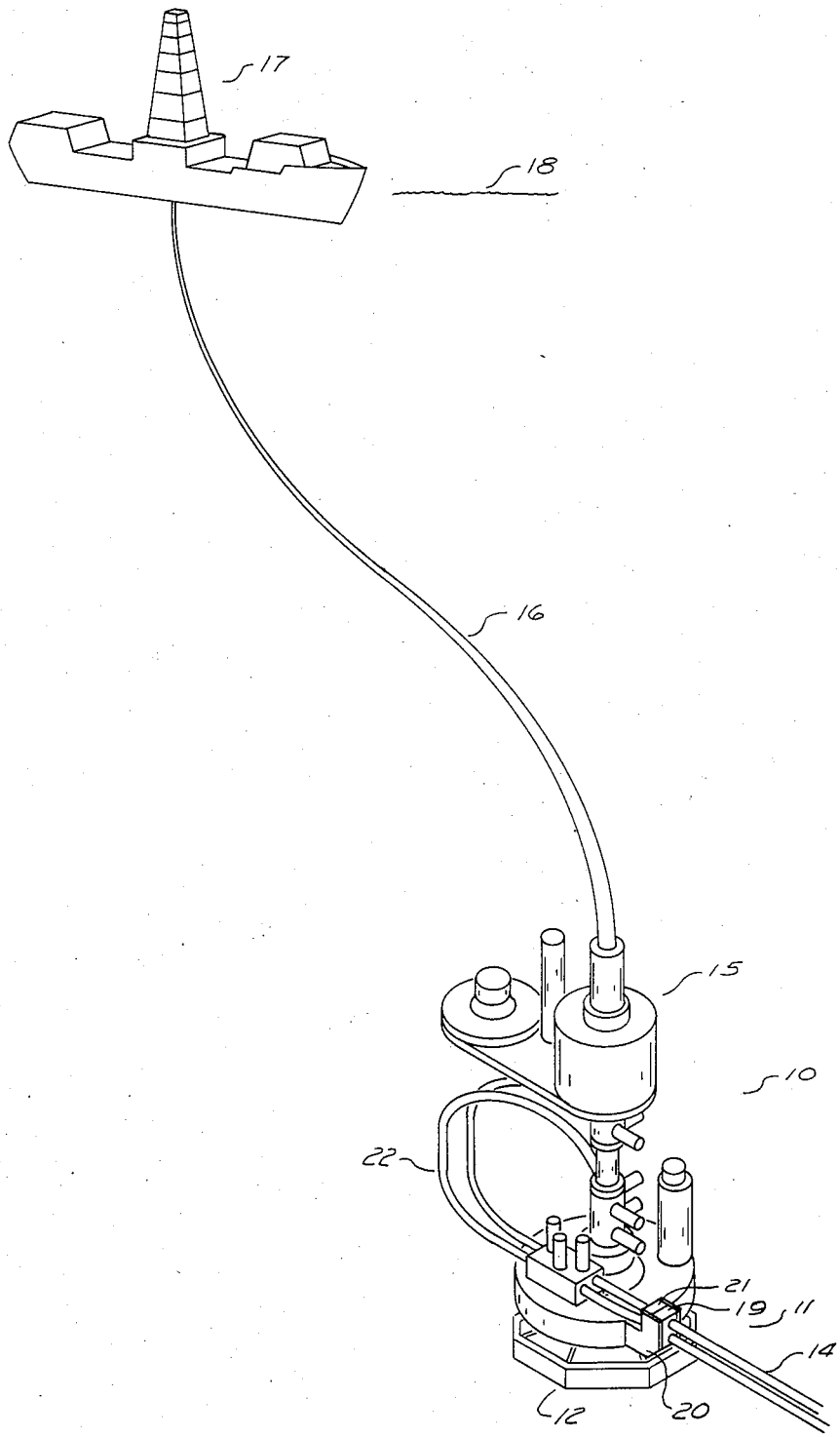

Referring to FIG. 1, the Christmas Tree 10 and flowline connection system 11 is shown landed on a wellhead and landing base system 12 on the ocean floor 13.

Flowlines 14 are laid along the ocean floor 13 to a distant facility (not shown) either on shore or to an offshore gathering facility above the surface of the water on a platform or the such like.

A tree running tool 15 is attached to the top of the Christmas Tree 10 and is connected to a running string of pipe 16 which goes up to a surface vessel 17 at the surface of the ocean 18 for the purposes of running, retrieving, or servicing the Christmas Tree 10.

The flowline connection system 11 generally comprises a sea floor flowline end connection 19 which is welded directly to the flowlines 14 and is attached to a flowline receiving structure 20 which in turn is mounted on the wellhead system 12 and a tree flowline end connection 21 which is welded to a tree flowline loop portion 22 which in turn is attached to the valving portion of the Christmas Tree 10.

As can be readily seen, if the Christmas Tree were to be landed slightly out of orientation and special consideration were not taken, the tree flowline end connection 21 might hit the sea floor flowline end connection and cause damage. As can also be seen, if the tree is landed approximately 180 degrees out of orientation the tree flowline loop portion 22 might hit the sea floor flowline end connection 19 and cause damage.

Figure 2:
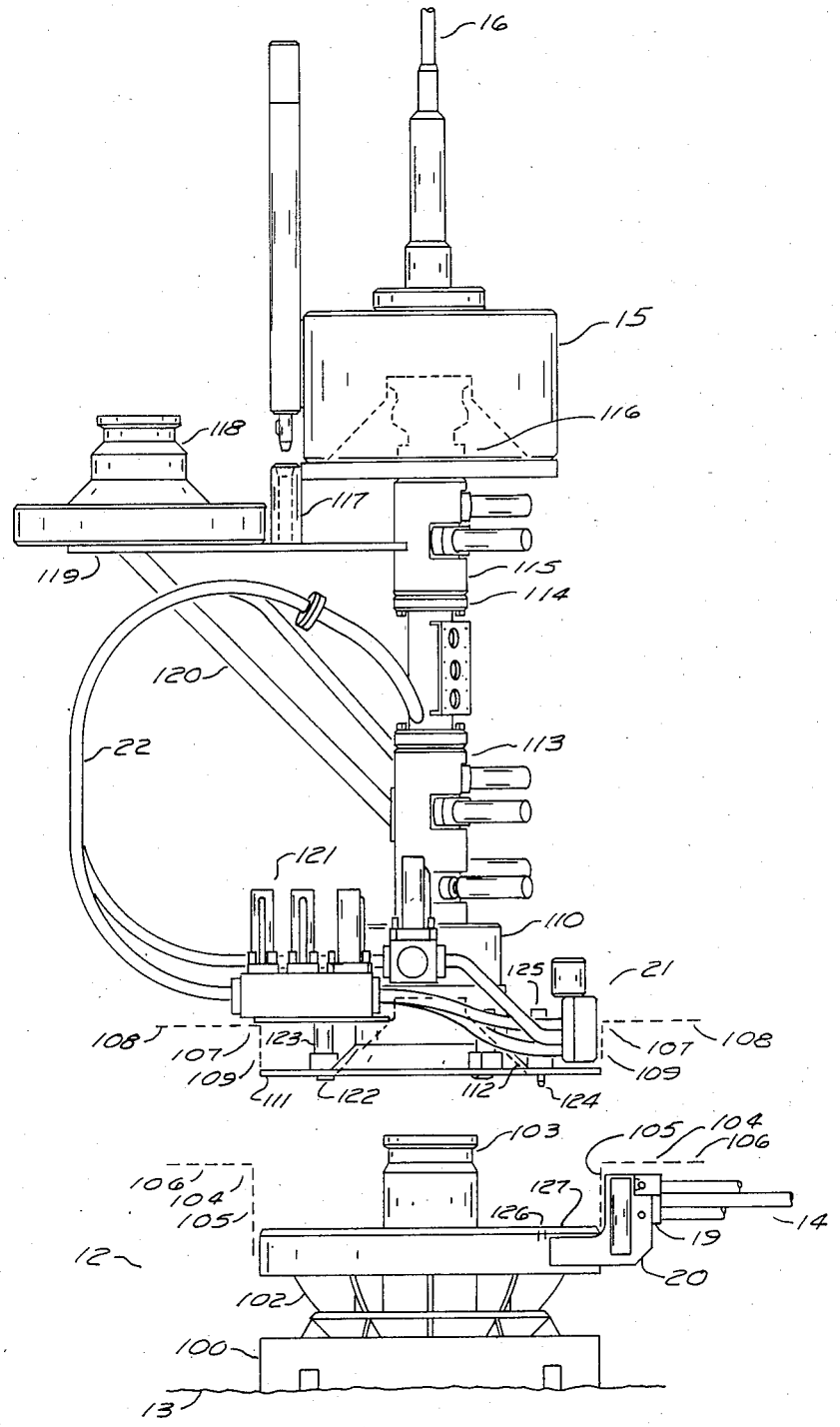

Referring now to FIG. 2, the wellhead system 12 can be seen more clearly landed on the ocean floor 13 with the temporary guide base 100 setting directly on the ocean floor 13 and the permanent guide base 101 setting on top of the temporary guide base with a gimbal 102 to allow the permanent guide base 101 to land level even when the ocean floor 13 is not level. Wellhead housing 103 is a circular member supported in the center of the permanent guide base 101 and suspending the well casing and tubing pipes within (not shown).

The dashed line 104 indicates a boundary including a vertical circular portion 105 and a horizontal portion 106 defining the area outside which and below which respectively the portions of the flowline connection associated with the sea floor end of the flowline must be positioned. In like manner, the dashed line 107 including vertical circular portion 108 and horizontal portion 109 define the area within which and/or above the flowline portions of the Christmas Tree must be contained during the running and orientation procedures. As the tree is landed the dashed line 107 must be equal to or within or above the dashed lines 104 such that there is no possibility of interference between the parts on the sea floor flowline end connection and the tree flowline end connection.

In this figure, the flowline receiving structure 20 and the sea floor flowline end connection 19 may appear to be within the area as set forth by dashed line boundary 104, however it is actually in front of and outside of the boundary in this view, as will be seen in later views.

The sea floor flowline end connection 19 is landed in and supported by the flowline receiving structure 20. The tree flowline end connection is supported by the Christmas Tree 10 in a manner to insure that the connection will be within the boundary 109 and the attached piping called the tree flowline loop portion 22 will also be above and/or within the boundary 107.

The Christmas Tree 10 is generally comprised of a wellhead connector 110, a lower flat baseplate 111, a funnel shaped area 112 to guide the wellhead connector 110 onto the wellhead housing 103, a master valve block 113, a wye spool 114, a swab valve block 115, a tree mandrel 116, a setback receptacle 117, a tree cap 118, a setback bracket 119, a setback support arm 120, wing and crossover valves 121, 3 or more support rollers 122, support roller cylinders 123, tree flowline loop portion 22, and tree flowline end connection 21.

Rollers 122 are mounted on cylinders 123 for the purpose of being shock absorbers when landing the Christmas Tree and to allow easy rotation of the tree without interference or wear on the seals between the tree 10 and the wellhead housing 103. During the running procedure a hydraulic pressure signal on the cylinders will cause the rollers to be extended down so that the tree will land about 3" above the final landed and locked position. After landing and rotation to the proper orientation, the fluid pressure will be released and the tree allowed to be lowered to the final position. In some cases, the rollers may be powered with motors to provide the rotation for the Christmas Tree 10 when landed, or the power for tree rotation may be provided directly by torque on the pipe string 16 back to the surface. Spring loaded pin 124 within spring housing 125 will engage hole 126 on upper surface 127 of permanent guide structure 101 when the Christmas Tree is properly oriented and lock the Christmas Tree in that orientation during the final lowering of the Christmas Tree.

Figure 3:
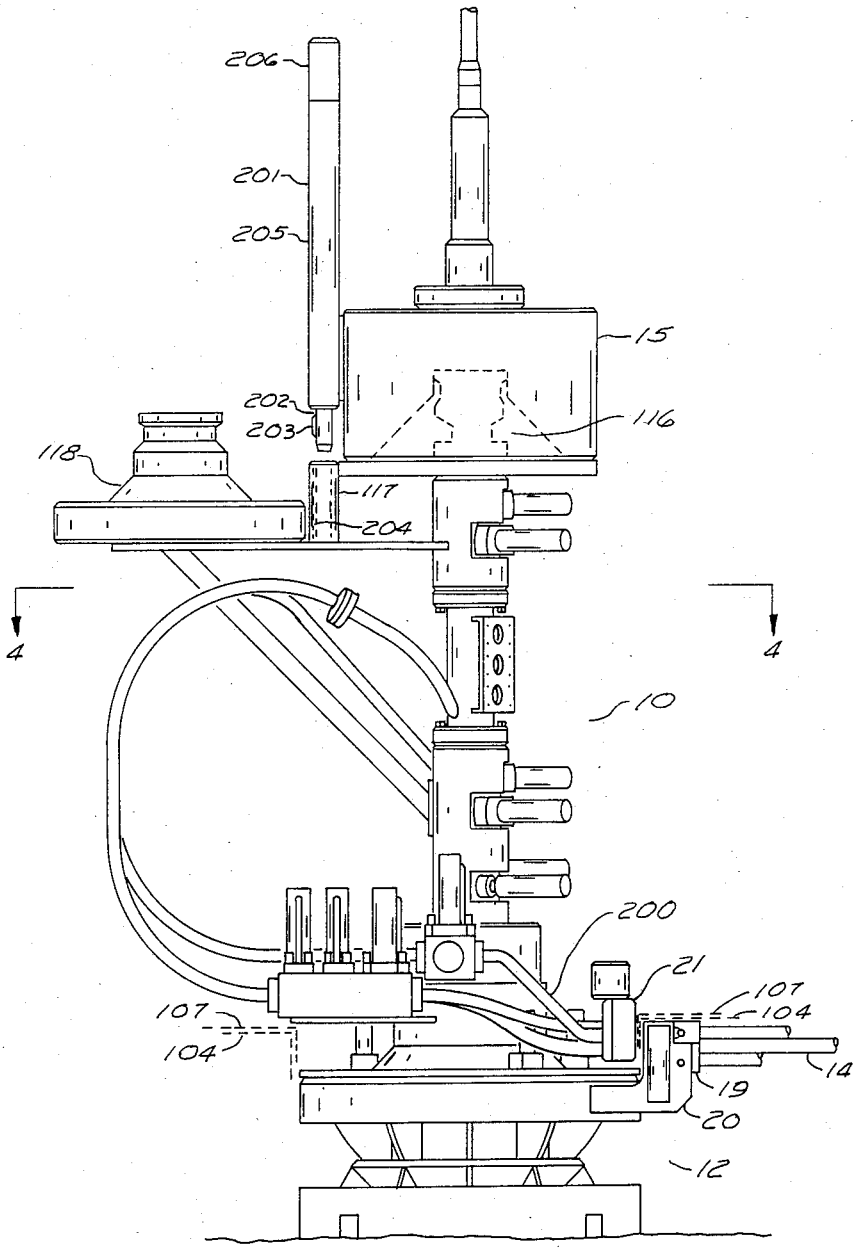

FIG. 3 shows shows that the Christmas Tree 10 has been landed on and properly oriented to the wellhead system 12, but that the tree flowline end connection 21 is still in the retracted position within the boundary 104.

The portion of the tree flowline loop portion 22 between the tree flowline end connection 21 and the wing and crossover valves 121 indicated as intermediate pipe section 200 provides sufficient curvature that the wing and crossover valves 121 and the tree flowline loop portion 22 on the opposite side of the Christmas Tree from the tree flowline end connection are displaced upwards enough to clear the circular boundary 107 and therefore the circular boundary 104. This means that the tree can be freely rotated as required to find the proper orientation. This figure illustrates the Christmas Tree in the proper orientation relative to the flowlines.

Figure 4:
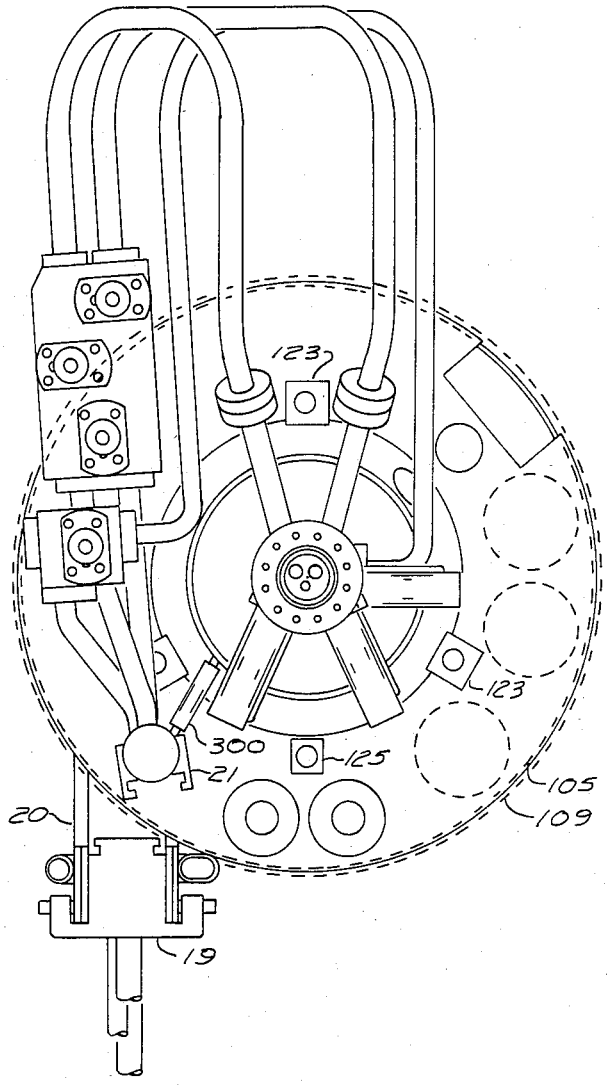

FIG. 4 shows a top view of FIG. 3 taken along lines "4—4" of FIG. 3 showing that in this case the tree flowline end connection 21 is completely within the vertical boundary 105 and the sea floor flowline end connection 19 and flowline receiving structure 20 are outside the vertical boundary 109. The boundaries 105 and 109 are approximately the size of the outer diameter of the lower baseplate 111 of the Christmas Tree 10 and the outer diameter of the permanent guide structure 101. As long as the tree flowline end connection 21 is kept within this restrained condition, the tree 10 is free to be rotated for orientation. Cylinder 300 is used to retain the tree flowline end connection 21 in the proper position.

Figure 5:
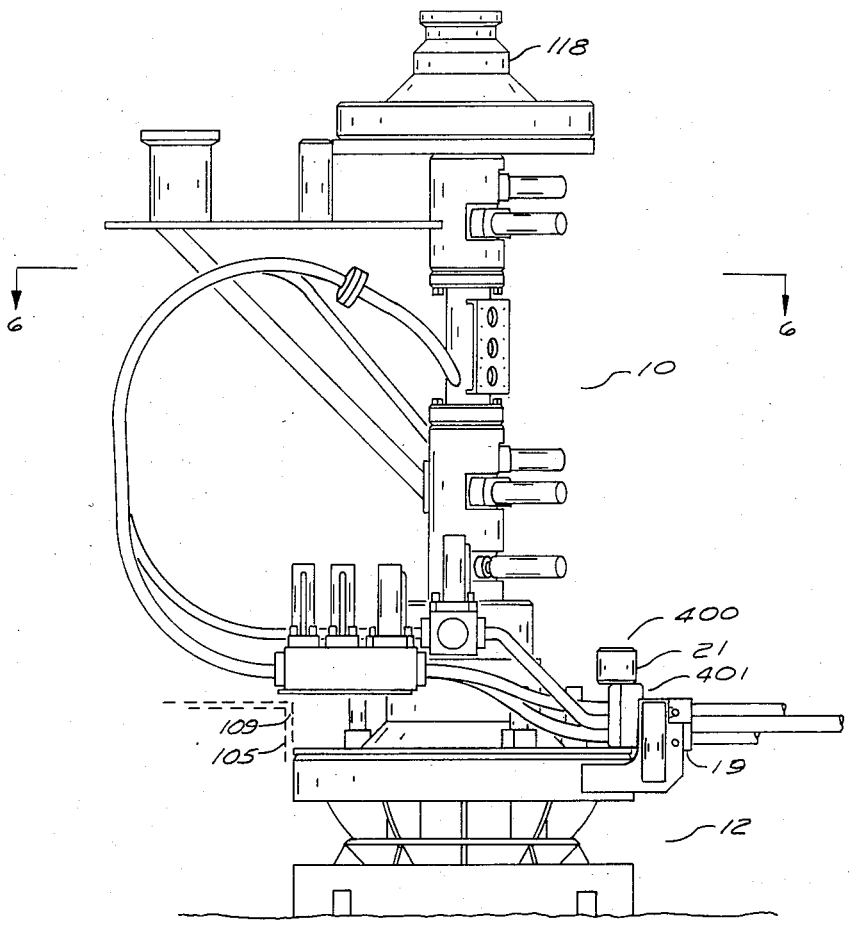

FIG. 5 shows the Christmas Tree 10 in the landed and locked position on the wellhead system 12 and the tree flowline end connection 21 moved forward thru the boundaries 105 and 109 and connected to the sea floor flowline end connection 19. Various means are available for this type of connection, with the illutrated means having a hydraulic cylinder 400 at the top to slide two side plates 401 down and latch against the two halves of the connection. See U.S. Pat. Nos. 3,886,677 and 3,924,446 for more detailed explanation of this type of equipment.

Referring again to FIG. 3 the tree running tool 15 has a setback post assembly 201 with a nose portion 202 for engaging the setback receptacle 17, a spring loaded key 203 for engaging slot 204 in the setback receptacle 117, a stroking cylinder 205 for vertical movement, and a rotary member 206 for rotating the tree running tool 15 about the setback receptacle. At this time the setback post assembly 201 can be stroked down to engage the setback receptacle 117, the tree running tool 15 released from the tree mandrel 116, the tree running tool picked up by the stroking cylinder 205, rotated approximately 180 degrees by the rotary member 206, and then the tree running tool landed on the tree cap 118. After locking the tree running tool 15 onto the tree cap 118, the procedure can be reversed to place the tree cap 118 onto the tree mandrel 116. The tree running tool 15 and the running string of pipe 16 are ready to be retrieved to the surface.

Figure 6:
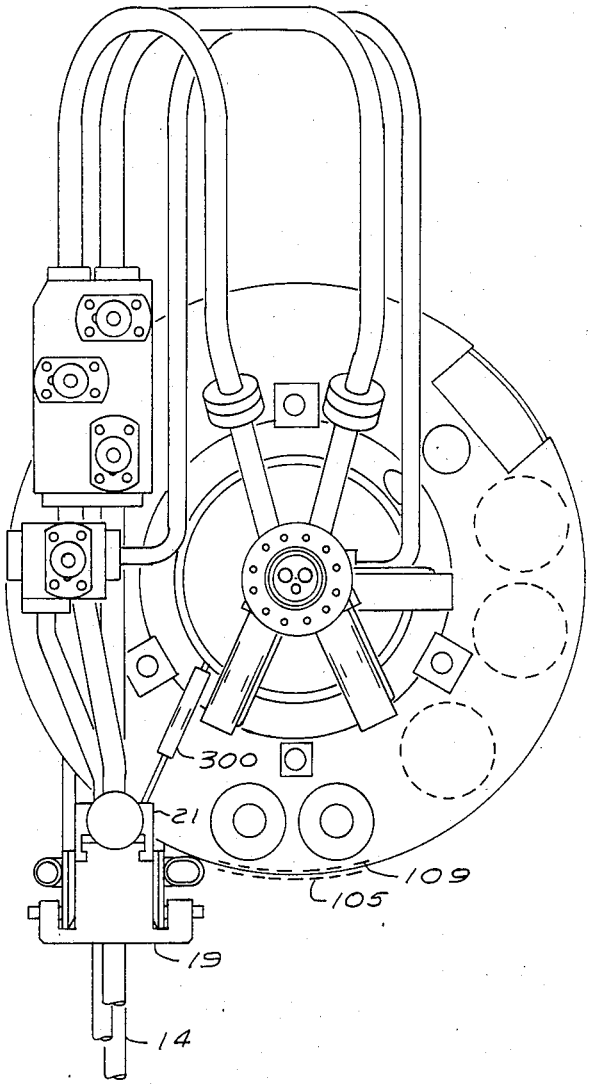

As soon as the tree cap 118 is landed on the mandrel 116, FIG. 6 along with FIG. 5 illustrate this completion system with the Christmas Tree properly landed and connected to the wellhead and landing base system 12 and the flowlines 14 and ready for production of oil or gas into the flowlines.

FIG. 6 taken along section line "6—6" of FIG. 5 shows a top view of the tree of FIG. 6 in which the tree flowline end connection 21 has passed thru the boundaries 105 and 109 to allow connection with the sea floor flowline end connection 19. The foregoing disclosure and description of this invention are illustrative and explanatory thereof, and various changes in the size, shape, and materials, as well as the details of the illustrated construction may be made without departing from the spirit of the invention.

I claim:

1. In a subsea completion system for the production of oil or gas from subsurface formations or the injection of liquids or gases into subsurface formations, a wellhead and landing base system supporting casing and tubing in a well bore and having a flowline receiving structure attached; a christmas tree assembly of valves, tree flowline portion, and fittings adapted to be lowered thru the ocean and landed on said wellhead and landing base system without the pre-orientation and guidance of guidelines from the surface of the water to the wellhead and landing base system and subsequently to be rotated to a preferred orientation; and flowlines along the sea floor, an invention comprising:

a substantially horizontal connection for connecting said flowline laid along said sea floor to said tree flowline portion comprising a sea floor flowline end connection attachable to said flowline along the sea floor and adapted to be received in said flowline receiving structure of said wellhead and landing base system and a tree flowline end connector attachable to said tree flowline portion, orientation means on said christmas tree co-operating with orientation means on said wellhead and landing base system for locating said christmas tree in a desired rotational relationship with respect to said wellhead and landing base system, means mounted on said christmas tree and connected to said tree flowline end connector for the purpose of moving said tree flowline end connector in a generally radial direction, a substantially vertical circular boundary generally concentric with said wellhead and landing base system radially separating said sea floor flowline end connection and said tree flowline end connector in the landing position of said christmas tree, a substantially horizontal boundary vertically separating said sea floor flowline end connector from the portion of the tree flowline portion which extends outside the diameter of said vertical concentric circular boundary, such that in the landed condition, said christmas tree, tree flowline end connection, and said tree flowline portion can be freely rotated to said preferred orientation without interference with said attached sea floor flowline end connection, and subsequently said tree flowline end connection can be moved substantially horizontally and radially to mate with said sea floor flowline end connection to allow the connection thereof.

2. In a subsea completion system for the production of oil or gas from subsurface formations or the injection of liquids or gases into subsurface formations, a wellhead and landing base system supporting casing and tubing in a well bore and having a flowline receiving structure attached; a christmas tree assembly of valves, tree flow loop portion, and fittings adapted to be lowered thru the ocean and landed on said wellhead and landing base system without the pre-orientation and guidance of guidelines from the surface of the water to the wellhead and landing base system and subsequently to be rotated to a preferred orientation; and flowlines along the sea floor, an invention comprising:

a subsea flowline connector comprising a sea floor flowline end connector and a tree flowline end connector, said sea floor end connector being adapted for installation on the end of said flowlines before said flowlines are laid on the ocean floor and adapted for being landed in said flowline receiving structure portion of said wellhead and landing base system such that the ports therethrough which communicate with the bores of said flowlines and said flowlines are substantially horizontal and such that the minimum distance from the center of said wellhead and landing base system to said sea floor end connector is a first radial distance, said tree flowline end connector being mounted in a first position on a said subsea christmas tree with is outermost parts at a second radial distance from the centerline of said wellhead and landing base system and therefore from the centerline of said christmas tree which is less than said first radial distance and ports thru said tree flowline end connector which communicate with the bores of said tree flowline portion being substantially horizontal;

such that when said christmas tree is landed on and centralized by said wellhead and landing base system said tree flowline end connector will remain at a shorter radial distance from the centerline than said sea floor flowline end connector and therefore will not contact said sea floor flowline end connector if said christmas tree is landed in an orientation other than the preferred orientation relative to said wellhead and guide base system and is subsequently rotated to the preferred orientation to said wellhead and guide base system, and further means are provided such that after said christmas tree is rotated to a preferred orientation said tree flowline end connection can be moved radially outwardly to a second position for connection with said seafloor flowline end connection.

3. The invention of claim 2, wherein said christmas tree can be rotated freely about the center of said wellhead and landing base system to an orientation to provide correct alignment of said tree flowline end connector with said sea floor flowline end connector for connection therebetween.

4. The invention of claim 3, wherein said tree flowline end connector can be moved substantially horizontally to a distance greater than said first radial distance to allow connection with said sea floor flowline end connector.

5. The invention of claim 4, wherein a hydraulic cylinder provides the force to move said tree flowline end connector substantially horizontally to allow said connection.

6. The invention of claim 4, wherein a tree flowline loop portion is connected to said tree flowline end connection on one end and to the valves of said christmas tree on the opposite end and the portion of said tree flowline loop portion at a radial distance from the center of said wellhead greater than said first radial distance being constrained to remain above a first height relative to said wellhead and said flowline receiving structure and said sea floor flowline end connection being constrained to remain below said first height relative to said wellhead.

7. The invention of claim 6, wherein rollers mounted on hydraulically actuated cylinders are provided to support the christmas tree on said wellhead and landing base system at a second height above said guide base system when said hydraulically actuated cylinders are pressured to allow for free rotation of said christmas tree without damage to seals between said christmas tree and said wellhead and said hydraulically actuated cylinders and rollers allow said christmas tree to be lowered to the final position after the correct orientation is found and the pressure is released from said hydraulically actuated cylinders.

8. The invention of claim 7, wherein a spring loaded pin is provided on said christmas tree to engage a hole on said wellhead and landing base system when the christmas tree has landed over said wellhead and has been rotated to the proper orientation for alignment of said tree flowline end connection with said sea floor flowline end connection.

* * * * *